United States Patent [19]

Buente et al.

[11] Patent Number: 4,607,599

[45] Date of Patent: Aug. 26, 1986

[54] ROLLER FOLLOWER HYDRAULIC TAPPET

[75] Inventors: Stephen M. Buente; David P. Clark, both of Battle Creek, Mich.

[73] Assignee: Eaton Corporation, Cleveland, Ohio

[21] Appl. No.: 734,634

[22] Filed: May 15, 1985

[51] Int. Cl.[4] ..... F01L 1/24

[52] U.S. Cl. ..... 123/90.5; 123/90.55; 123/90.48

[58] Field of Search ..... 123/90.5, 90.55, 90.48

[56] References Cited

U.S. PATENT DOCUMENTS

| | | | |
|---|---|---|---|
| 2,765,783 | 10/1956 | Randol | 123/90.5 |
| 3,089,472 | 5/1963 | Thompson | 123/90.5 |
| 3,314,303 | 4/1967 | Maat | 123/90.5 |
| 4,089,234 | 5/1978 | Henson et al. | 123/90.5 |
| 4,361,120 | 11/1982 | Kueny | 123/90.5 |
| 4,448,155 | 5/1984 | Hillebrand et al. | 123/90.5 |

FOREIGN PATENT DOCUMENTS

| | | | |
|---|---|---|---|
| 864779 | 12/1952 | Fed. Rep. of Germany | 123/90.55 |
| 882172 | 5/1943 | France | 123/90.55 |

*Primary Examiner*—Ira S. Lazarus

*Attorney, Agent, or Firm*—C. H. Grace; R. A. Johnston

[57] ABSTRACT

A hydraulic lash adjusting tappet for an internal combustion engine of the type supplying oil to a passage communicating with the tappet-receiving guide bore in the engine. The tappet has a roller follower on the cam end and a registration means adjacent the opposite end for orienting the roller with respect to the engine cam. The tappet body has at least one localized collector recess disposed longitudinally coincident and peripherally spaced with the registration means. In one embodiment the registration comprises a pair of oppositely disposed flats and the tappet has a pair of diametrically opposed collector recesses interconnected by a peripheral groove spaced longitudinally therefrom to by-pass the flats and provide sufficient surface for leakage control. An oil inlet hole is formed in one of the collector recesses for supplying the lash adjuster valve in the tappet. The localized recess is aligned with the engine supply passage by the orientation of the registration surface.

10 Claims, 8 Drawing Figures

ROLLER FOLLOWER HYDRAULIC TAPPET

BACKGROUND OF THE INVENTION

The present invention relates to hydraulic lash adjusting tappets of the type having a roller follower for contacting the cam shaft in an internal combustion engine valve gear. In modern overhead cam type engine valve gear, it has been desired to reduce the power consumption of the valve gear by providing roller followers on the hydraulic tappet to reduce the frictional forces created by contact of the engine cam shaft with the tappet. However, in valve gear of the overhead cam type where the tappet is the only link between the cam shaft and the valve rocker arm, i.e. where there is no push rod between the tappet and the rocker arm, space constraints have made the incorporation of roller follower tappets in existing engines quite difficult.

Where an existing valve gear of the overhead cam type having flat base tappets contacting the cam is desired to be converted to roller follower tappets, it has been found difficult to provide for maintaining proper tappet orientation and the addition of the roller follower within the length constraints established for the engine by the fixed distance between the cam shaft and the rocker arm. When converting an overhead cam engine valve gear to roller follower tappets, it is necessary to not only shorten the hydraulic lash adjusting components by an amount sufficient to provide for the incorporation of the roller follower, but it is also necessary to provide for orientation of the tappet to maintain the alignment of the roller follower with the cam. It is also necessary to maintain the supply of fluid from the engine oil flow circuit to the interior of the tappet for supplying the hydraulic lash adjusting valve. Tappets of the type having flat base frictional contact with the cam lobe may rotate freely in the tappet guide bore in the engine. In order to maintain the tappet roller oriented properly with respect to the engine cam load, registration surfaces are usually provided on the tappet for sliding engagement with a guide means provided on the engine to maintain the proper tappet orientation.

This problem of length constraints is not encountered in retrofitting engines having push rod type valve gear with roller follower tappets such as shown in FIG. 8 because the tappet may be increased in length to accommodate the roller follower and the orientation means or registration surfaces and the wide circumferential collector groove employed to fluidly connect with the engine oil circuit left intact, and the push rod shortened accordingly to compensate for the increased tappet length.

SUMMARY OF THE INVENTION

The present invention enables an overhead cam type valve gear for an internal combustion engine having hydraulic lash adjusting tappets to be retrofitted with such tappets having roller followers for contacting the cam to absorb less power from the engine in the valve gear. The present invention provides a unique and novel hydraulic lash adjuster having a roller follower on one end of the tappet body and suitable means for registration provided on the opposite end for sliding contact with a guide to maintain the roller properly oriented for contact with the engine cam shaft.

The present invention enables a roller follower tappet to be retrofitted in an engine having a overhead cam type valve gear without altering the distance between the cam shaft and the valve rocker arm. The novel tappet of the present invention incorporates the roller follower registration surfaces in the tappet and does not exceed the length allowed for a tappet not having such features. The tappet of the present invention provides for an oil feed circuit from the passage in the tappet guide bore in the engine to the one way valve within the tappet by providing a novel registration means and a localized collector means at a longitudinally common station oriented by the registration means for feeding the oil inlet hole in the tappet from the engine gallery to the tappet guide bore.

DETAILED DESCRIPTION

Figure 1:
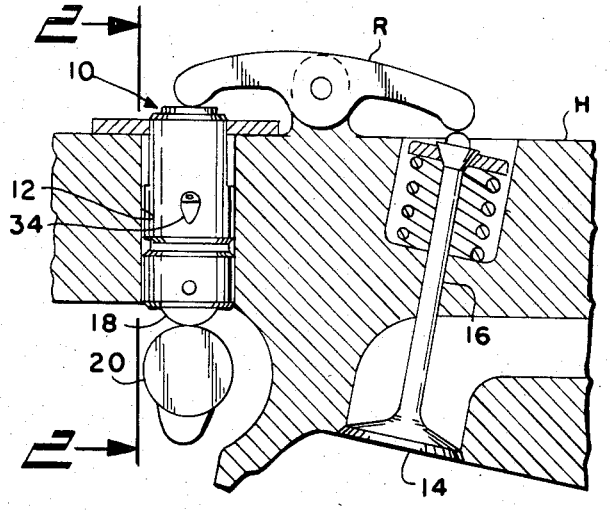
FIG. 1 is a cross section of a portion of an engine cylinder head illustrating the tappet of the present invention installed in the engine valve gear.

Referring now to FIG. 1, the tappet of the present invention is indicated generally at 10 as received in a guide bore 12 provided in the cylinder head H of an internal combustion engine having a combustion chamber valve 14 with a stem 16 contacting the pivoted rocker arm R at one end thereof, with the opposite end of the rocker arm contacting the upper end of tappet 10. The lower end of the tappet 10 has a roller follower 18 which contacts in rolling engagement a cam shaft 20 rotatably mounted in the engine. The cylinder head H has an oil gallery 22 which communicates via passage 24 with the bore 12.

Figure 2:
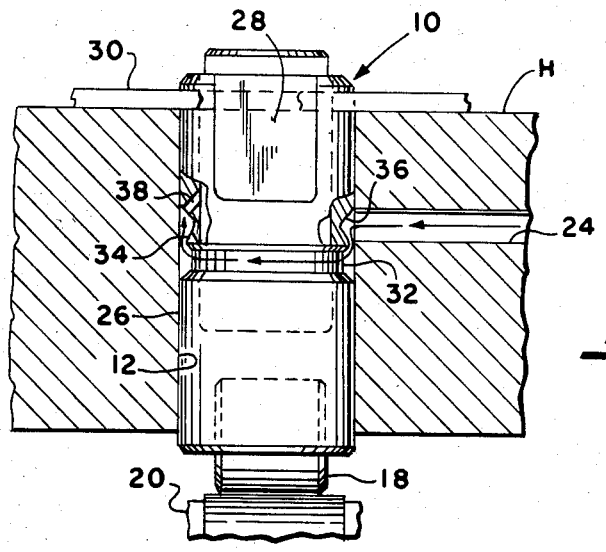
FIG. 2 is an enlarged view of a portion of FIG. 1 showing the details of the tappet oil feed circuit with portions of the tappet broken away.

Referring now to FIG. 2, the tappet 10 has the body 26 thereof slidably received in bore 12 in closely fitting contact therewith. The tappet body 26 has orienting registration means comprising an especially configured surfaces such as a pair of flats 28, 29, one of which is indicated at 28 on the body 26 adjacent the upper end thereof in FIG. 2. The flats 28, 29 are on opposite sides of the body 26, which registration surfaces or flats 28, 29 slidably engage a corresponding configured aperture (not shown) formed in a retaining guide 30 received over the upper end of the tappet. The registration surfaces or flats such as 28 function when registered against the sides of the aperture in guide 30, to orient the tappet in the bore so as to insure proper alignment of the axis of roller follower 18 for running contact with the cam 20. A pair of diametrically opposed localized collector resesses indicated by reference numerals 34, 36 are provided which communicate with a collector groove 32 formed circumferentially about the periphery. An oil inlet hole 38 is provided in recess 34 and communicates with the lash adjustment valve means (not shown) provided on the interior of the tappet 10 in a manner well known in the art.

Figure 3:
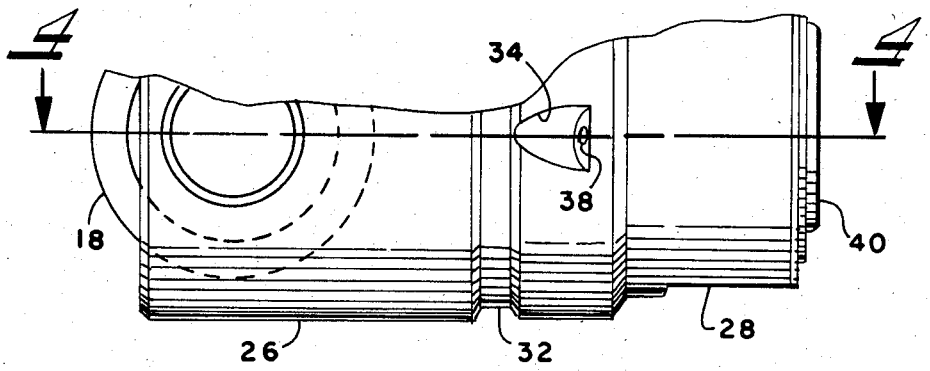
FIG. 3 is a side view of the tappet of FIG. 2.
Figure 4:
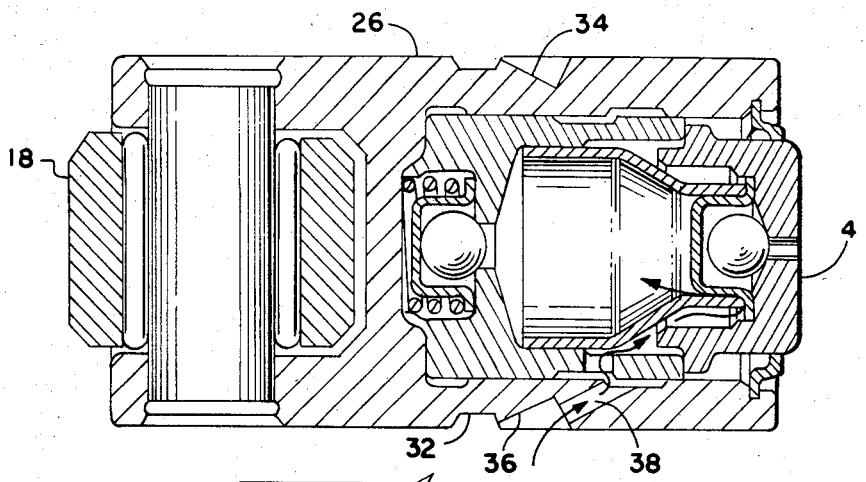
FIG. 4 is a section view taken along section indicating lines 4—4 of FIG. 3.
Figure 5:
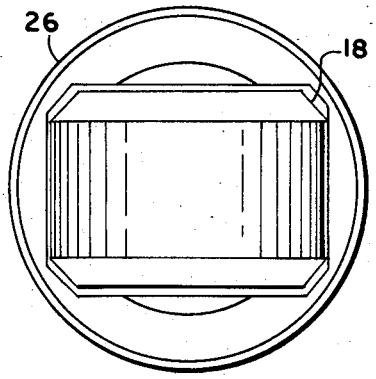
FIG. 5 is an end view of FIG. 4.
Figure 6:
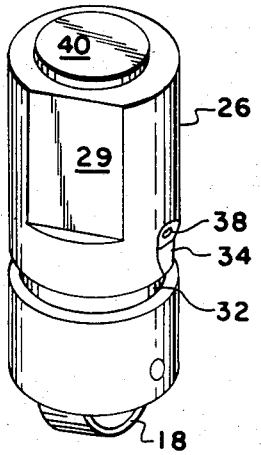
FIG. 6 is a perspective view of the tappet of FIG. 2.

Referring to FIG. 4, the oil inlet hole 38 is formed through the wall of body 26 and is shown as providing a passage for engine lubricating oil into the interior of the tappet mechanism to facilitate lash adjustment. A plunger assembly 40 is moveably received in the body 26 and extends from the upper end of the tappet body 26 in FIG. 2 or the rightward end in FIGS. 3 and 4 for contacting the rocker arm R and maintaining the lash-adjusted length of the tappet. The passage of oil through the inlet hole 38 to the interior of the body for supplying the lash adjustment mechanism is shown in solid black line with black arrowheads in FIG. 4.

It will be understood that the tappet body 26 may be assembled into the engine bore 12 with either of the recesses 34, 36 oriented to be adjacent the oil passage 24 when the bracket 30 is received over and registered against the registration flats 28, 29. Thus, no concern need be given during assembly as to orientation of the tappet once the bracket 30 is engaged with the registration flats. With particular reference to FIG. 2, the tappet is shown assembled into the engine bore 12 with the localized recess 34 disposed remotely or 180° away, from the oil passage 24. When the tappet is assembled in the engine as shown in FIG. 2, the oil inlet hole 38 receives oil from passage 24 via recess 36, oil groove 32 and recess 34 as shown in solid black line with black arrowheads in FIG. 2.

It will be understood that the tappet 10 is illustrated in FIG. 2 in the downwardmost, or valve closed, position with the roller 18 contacting the cam 20 on its base circle. In the base circle position of FIG. 2, the tappet body 26 has the exterior oil collector groove 32 provided thereon located such that the upper edge of the groove is below the lower surface of the oil passage 24. However, the localized recesses 34, 36 each have a sufficient longitudinal extent along the surface of the tappet body 26 so that fluid communication is always maintained from engine oil passage 24 to tappet oil inlet 38.

The construction of the tappet of the present invention permits the oil collector groove 32 as shown in FIG. 2, to pass oil around the circumference of the tappet from the localized collector 36 when the tappet is on the base circle of the cam and the collector groove 32 cannot communicate directly with the passage 24. This arrangement enables room for the flats 28, 29 to be provided on the outer periphery of the tappet body to accomodate the full lift stroke of the tappet as the cam rotates.

The embodiment of FIG. 2 also provides sufficient surface area around the periphery of the tappet in a region above the groove 32 for cooperation with the wall of bore 12 to provide a land for leakage control to prevent rapid flow of oil from groove 32 to the flats 28, 29 and a corresponding loss of oil pressure in the engine oil circuit.

Figure 7:
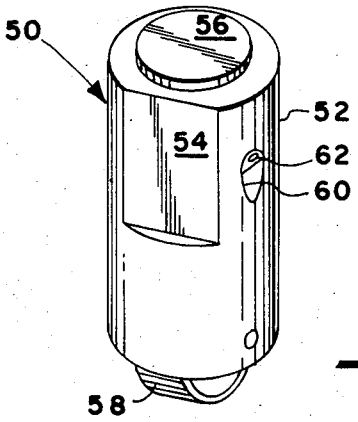
FIG. 7 is a view similar to FIG. 6 and illustrates another embodiment of the invention having a single flat for the registration means and a single localized collector recess; and, FIG. 8 is a view similar to FIG. 1 showing the prior art roller follower tappet in push rod type valve gear.
Figure 8:
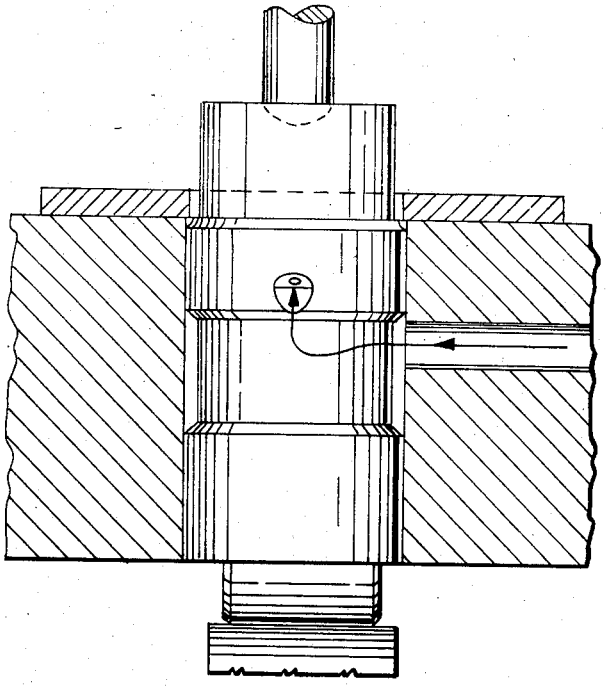
PRIOR ART Fig. 8

Referring to FIG. 7, another embodiment indicated generally of 50 of the invention is shown in which the body 52 has registration means comprising a single flat 54 formed on the periphery of the body at the end adjacent the moveable plunger assembly 56. The tappet 50 also has a roller follower means 58 provided on the end of the body remote from plunger assembly 56. The single flat 54 is adapted to be installed in a corresponding configured aperture (not shown) in a guide bracket, such as bracket 30 (see FIGS. 1 and 2). The tappet of FIG. 7 has a localized collector recess 60 provided on the periphery thereof and spaced circumferentially, preferably 90°, from the registration flat 54. The recess 60 is located at a longitudinal station coincident with flat 54 and engine oil feed passage 24 when the tappet 50 is assembled in the engine bore 12. The recess 60 extends longitudinally along the tappet periphery a distance sufficient to maintain the recess 60 always in fluid communication with engine oil passage 24 throughout the full lift cycle of the cam 20.

Recess 60 has a tappet fluid inlet port 62 located therein for communicating fluid to the interior of the tappet for operation of the hydraulic lash adjusting movement of plunger 56. The embodiment of FIG. 7, thus permits the oil inlet to be longitudinally at a common station with registration flat 54, yet maintain sufficient leakage control surface for preventing loss of oil pressure by too rapid flow to flat 54. The embodiment of FIG. 7 also eliminates concern for tappet orientation during assembly into the engine.

The present invention thus provides a compact roller follower hydraulic lash adjuster which enables retrofitting of roller follower tappets in an existing overhead cam engine having flat face cam tappets without the need to alter the location of the cam with respect to the other valve gear components. The present invention provides proper orientation of the tappet for feeding of oil to the tappet lash adjusting mechanism irrespective of the orientation of the tappet in the engine bore when registered against the guide means for aligning the roller follower correctly with respect to the cam shaft.

Although the invention has been described hereinabove with respect to the illustrated embodiments, it will be understood that modifications and variations of the invention may be made by those having ordinary skill in the art and the invention is limited only by the following claims.

We claim:

1. A hydraulic lash adjusting tappet for use in the valve gear of an internal combustion engine comprising:

(a) body means having the outer periphery thereof adapted for sliding movement in a bore provided in the engine, said bore of the type supplied by an oil passage communicating therewith;

(b) roller follower means rotatably received on one end of said body means, said roller follower means adapted for rolling contact with an engine camshaft;

(c) registration surface means adapted for moveable registration thereagainst comprising at least one especially configured surface formed on said body means remote from said follower means and adapted for registration thereagainst for orienting said body means in said bore for ensuring proper alignment of said roller means with the engine camshaft;

(d) plunger means, including hydraulic lash adjusting means, said plunger means moveably received in a cavity formed in said body means, said plunger formed to interfit said cavity so as to form a hydraulic pressure chamber and define precision leakdown surfaces therebetween;

(e) said body means defining a fluid inlet port disposed on the periphery thereof for communicating with said engine bore oil passage when said body means is oriented in said bore by said registration means, said body means further defining a pair of localized collector surface means diametrically opposite thereon, said collector surface means disposed axially coincident with and circumferentially spaced from said registration surface means to provide a circumferentially staggered and on the periphery of said body means for leakage control between said body means and said engine oil bore one of said surface means disposed to communicate with said fluid inlet port, said collector surface means further including passage means operable to maintain communication of said engine bore oil passage with said fluid inlet port during movement of said body means in said engine bore caused by contact of said roller means with said engine camshaft.

2. The device defined in claim 1, wherein registration means comprises a pair of flats disposed on oppoiste sides of said body means and said fluid inlet port and collector surface means are located peripherally in quadrature with said flats.

3. The lash adjuster defined in claim 1, wherein said pasage means comprises a collector groove extending around the periphery thereof and communicating with said localized collector surface means.

4. A hydraulic lash adjuster for use in the valve gear of an internal combustion engine comprising:

(a) body means having the outer periphery thereof adapted for sliding movement in a bore provided in the engine, said bore of the type supplied by an oil passage communicating therewith;

(b) roller follower means rotatably received on one end of said body means, said roller follower means adapted for rolling contact with an engine camshaft;

(c) said body means defining a cavity and having plunger means slidably received therein, to form a high pressure chamber said plunger means including one-way valve means supplying said chamber;

(d) orientation means comprising at least one registration surface formed on said body means and adapted for being contacted to align said roller follower means with the engine camshaft;

(e) fluid inlet means formed in said body means for communicating fluid from said engine oil passages to said one way valve means, said inlet means comprising, (i) a localized collector recess formed on the periphery of said body at orientation with respect to said at least one at a generally common longitudinal station along said body means with said at least one registration surface and circumferentially spaced therefrom to provide a circumferentially staggered land on a periphery of said body means for leakage control between said body means and said engine oil bore, (ii) a feed aperture formed through the wall of said body means and communicating with said cavity, said feed aperture disposed circumferentially in quadrature and at a common longitudinal station along said body means with said localized collector means, (iii) connector groove means formed in the periphery of said body means and extending circumferentially thereabout for interconnecting said localized collector means and said feed aperture; wherein said connector groove means provides a circumferential by-pass about said orientation means.

5. The hydraulic lash adjuster defined in claim 4, wherein said registration means comprises a pair of flats disposed oppositely on said body means in spaced parallel relationship.

6. The hydraulic lash adjuster defined in claim 4, wherein said registration means comprises a pair of flats disposed oppositely on said body means in spaced parallel relationship, and said localized collector means comprises a pair of oppositely disposed recesses located circumferentially intermediate said flats.

7. The hydraulic lash adjuster defined in claim 4, wherein said registration means comprises a pair of flats disposed oppositely on said body means in spaced parallel relationship and said collector groove means is longitudinally intermediate said flats and said roller follower means.

8. The hydraulic lash adjuster defined in claim 4, wherein said localized collector means comprises a pair of oppositely disposed recesses and said feed aperture is formed in one of said recesses.

9. The hydraulic lash adjuster defined in claim 4, wherein said localized collector means is disposed on said body means intermediate said orientation means and said connector groove.

10. A hydraulic lash adjusting tappet for use in the valve gear of an internal combustion engine of the type having a bore provided therein with an oil passage communicating therewith and a camshaft for periodic tappet movement, said tappet comprising:

(a) body means having the outer periphery thereof adapted for sliding movement in said bore;

(b) roller follower means rotatably received on one end of said body means, said roller follower means adapted for rolling contact with said engine camshaft;

(c) registration surface means adapted for moveable registration thereagainst comprising at least one especially configured surface formed on said body means remote from said follower means and adapted for registration thereaginst for orienting said body means in said bore for ensuring proper alignment of said roller means with the engine camshaft;

(d) plunger means, including hydraulic lash adjusting means, said plunger means moveably received in a cavity formed in said body means, said plunger formed interfit said cavity so as to form a hydraulic pressure chamber and define precision leakdown surfaces therebetween; and, (e) said body means further comprising at least one localized collector surface means disposed on the periphery of said body means and spaced circumferentially from said especially one configured surface and longitudinally at a common station therewith, said collector surface means having a fluid inlet passage located therein communicating with said hydraulic lash adjusting means, said collector surface configured to extend longitudinally an amount sufficient to maintain said fluid communication between said engine oil passage and said fluid inlet passage during sliding movement of said tappet in said engine bore, said collector surface means disposed to define a circumferentially staggered land on the periphery of said body means for leakage control between said body means and said engine oil bore for preventing pressure loss from oil flow from said engine passage to said especially one configured surface, wherein, upon receipt of said tappet in said engine bore and contact with said registration means, said localized collector surface means is oriented in said bore with said engine oil passage.

* * * * *